United States Patent [19]

Terry

[11] Patent Number: 4,641,711

[45] Date of Patent: Feb. 10, 1987

[54] TERMINATING PERSISTENT UNDERGROUND COAL FIRES

[76] Inventor: Ruel C. Terry, 3090 S. High St., Denver, Colo. 80210

[21] Appl. No.: 740,980

[22] Filed: Jun. 4, 1985

[51] Int. Cl.[4] ..... A62C 1/12; A62C 3/02

[52] U.S. Cl. ..... 169/44; 169/46; 169/64; 405/128; 405/258

[58] Field of Search ..... 169/44, 46, 47, 64, 169/69, 70; 405/128, 258, 267, 269; 166/285; 299/10, 12, 13

[56] References Cited

U.S. PATENT DOCUMENTS

| | | | |
|---|---|---|---|
| 3,421,587 | 1/1969 | Heavilon et al. | 169/46 |
| 3,500,934 | 3/1970 | Magnuson | 169/46 |
| 3,852,967 | 12/1974 | Stewart et al. | 405/128 |
| 3,927,719 | 12/1975 | Maser | 169/46 |
| 4,102,397 | 7/1978 | Terry | 166/261 |
| 4,237,182 | 12/1980 | Fulmer et al. | 169/64 |
| 4,437,520 | 3/1984 | Stoddard et al. | 166/261 |

*Primary Examiner*—Joseph F. Peters, Jr.
*Assistant Examiner*—Michael J. Forman
*Attorney, Agent, or Firm*—Ruel C. Terry

[57] ABSTRACT

A series of specialty formulations of foaming mud cement are injected into an underground cavity containing an active coal fire. The fire is smothered and terminated with a blanket of foaming mud cement that sets into a cellular concrete. The lower section of the backfill involves a formulation of foaming mud cement containing materials conducive to heat transfer, thus forming a heat sink for dispersion of elevated temperature associated with the fire. The backfill continues to complete cavity fill using a formulation of foaming mud cement wherein the aggregate is composed of hazardous waste materials that are permanently stored within the cellular concrete.

12 Claims, 5 Drawing Figures

TERMINATING PERSISTENT UNDERGROUND COAL FIRES

FIELD OF THE INVENTION

This invention relates to terminating underground coal fires by smothering the fire with backfill material. More particularly, the invention teaches methods of eliminating localized hot spots using specialty formulations of foaming mud cement which hardens into cellular concrete. This invention extends the teachings of U.S. Pat. No. 4,437,520 of Stoddard et al and the references cited therein, and the teachings of pending patents Ser. No. 06/595,628, filed 04/02/84 and Ser. No. 06/699,783, filed 02/08/85, both of the present inventor.

BACKGROUND OF THE INVENTION

There are several hundred underground coal fires currently burning out out of control in the United States, the number of such fires remaining relatively constant through the years due to accidental starting of new fires about as often as old fires are terminated. Frequently these fires are in abandoned coal mines. In other cases the fires began at an outcrop of virgin coal, then propagated underground. In some cases extensive fire termination procedures have been applied at a site to the point where it was concluded that positive fire termination had occurred, only to discover years later that the fire is still active. Underground coal fires are difficult to terminate positively.

One common problem is present in all underground coal fires: localized hot spots associated with the fire. The overburden and underburden of a coal seam typically are poor conductors of heat, as is the coal itself. Thus localized hot spots can remain at a temperature conducive to reignition for long periods of time measured in decades. Should a source of oxygen become available to the localized hot spot, propagation of the fire can resume. Since it is virtually impossible to assure that future source of oxygen will not become available, steps should be taken during fire termination to eliminate localized hot spots as a standard procedure.

Specialty formulations of foaming mud cement have been demonstrated to be effective in terminating coal fires. This material may be described as a mixture of cement and/or lime, soil as the aggregate, and water, with the foaming action provided by carbon dioxide. The practical mixtures of foaming mud cement expand in the range of 1.0 to about three times the original volume, then set into cellular concrete with compressive strengths suitable to replace the missing coal. Freshly mixed foaming mud cement is applied to burning coal, quickly forming a crust over live coals, thereby snuffing the fire. Upon initial contact of foaming mud cement with live coals, water normally used for hydration of the mixture is flashed to steam and carbon dioxide is released through expansion, both actions serving to lower the temperature of the localized hot spot. Continuing application of foaming mud cement forms a crust, then serves as a backfill for the burn cavity. Preferably the complete cavity is filled to terminate potentially serious problems of subsidence.

In the use of foaming mud cement as described in the foregoing paragraphs, there is a transition zone between the snuffed coal and the set cellular concrete. The transition zone is approximately one to three inches thick, depending on whether the coal fire is in a smoldering state or in active flaming. Within the zone are char, ashes, unhydrated cement and/or lime, and soil or other aggregate. Outside the transition zone, on one side is the remnant coal at elevated temperature and on the other side is the foaming mud cement which begins setting into cellular concrete within a few hours.

Ordinary concrete is a relatively poor conductor of heat. Cellular concrete is a much better insulator against flow of heat that it is as a conductor of heat. Thus cellular concrete as described in the foregoing paragraphs is not suitable to assure timely elimination of localized hot spots.

INTRODUCTION

One of the favorable attributes of foaming mud cement is that the aggregate portion can be made up of plentiful soils at the project site, preferably soils that are unsuitable for agricultural purposes. It is likely that such preferable soils will be poor conductors of heat. This is no problem when the objective is economical backfill in burned out cavities devoid of local hot spots. For those underground cavities in the immediate vicinity of an active coal fire, it is preferable that the aggregate portion of foaming mud cement have fair to good heat transfer characteristics. Thus, the backfill in the hot portion of the underground cavities serves as a heat sink to equalize temperatures in a relatively short period of time.

Improving thermal conducitivity of cellular concrete can be accomplished in several ways. Short lengths of small diameter wire can be added to the foaming mud cement mixture, so that the mixture can be readily pumped in transit to the underground cavity. In this manner the multiplicity of short wires can be dispersed through the mixture in random alignments. Preferably the wires are less than one inch in length and less than two millimeters in diameter. The wires can be made of copper, aluminum, iron, steel or other material with effective heat transfer characistics. In lieu of wire lengths, small spheres of those materials can be added to the mixture, preferably in sizes approximating buckshot. Similarly, shapes of heat conductive additives can be in random forms, with due regard for dispersion throughout the mixture which should be readily pumpable.

Generally, however, it is preferable for economic reasons that the heat conductive aggregate not be in forms requiring manufacturing steps. From an aggregate dispersion point of view, it is preferred that the aggregate be in random sizes that pass through a quarter inch screen. There is a wide variety of materials that are suitable aggregates; for examples: ore grades of bauxite, laterite, kaolinite, pistolite, hematite, magnetite, limonite, taconite and others. In some cases these may be blended with the local soil aggregate to arrive at the desired level of thermal conductivity in the cellular concrete for an effective heat sink. Due regard should be paid to the problem of too rapid a heat transfer into the foaming mud cement, wherein the water needed for hydration of the cement is driven out of the mixture, resulting in an excessively thick transition zone. In that case compressive strength of the backfill material is significantly reduced in the transition zone, resulting in weakening one of the favorable attributes of cellular concrete: ability to support the cavity roof to prevent subsidence.

Foaming mud cement has another favorable attribute that is useful in underground fire termination. Obviously, there is a harsh environment at the contact between burning coal and the applied foaming mud cement, which ultimately becomes the transition zone between the coal and the cellular concrete. During the formation of the transition zone, generated gases (principally steam) are under sufficient pressure to form channels through the foaming mud cement. These channels quickly heal by collapse, and thus the foaming mud cement reaches a final set as an effective barrier to further incursion of oxygen that could rekindle the fire.

By use of thermal conductive aggregates in the foaming mud cement, as described in foregoing paragraphs, an additional benefit is attained by converting that portion of the set cellular concrete into a heat sink to lower the temperature of residual coal. The heat sink portion of the set cement generally requires only a small volume, compared to the volume of cement required to completely fill the underground cavity. Thus it is apparent that this larger volume, the remainder of the cavity fill, lends itself to the use of other aggregates in the foaming mud cement formulation.

In many cases of underground coal fires burning out of control, the sites are in locations far removed from population centers. In these sites, as well as similar sites of abandoned mines, aggregates of hazardous waste materials can be used. In this manner, two problems can be solved at a single site: stabilizing the old mine and providing a repository for hazardous waste material.

Foaming mud cement is a versatile material due to the variety of formulations that can be adjusted to site specific requirements. When used as a backfill in abandoned mines, the material can be foamed with common gases such as carbon dioxide, nitrogen, air, hydrogen and the like, which increases the volume of set cellular concrete up to about three times the volume of the original foaming cement formulation. Like many relatively straight-forward processes, technical finesse is required for successful results in attaining uniform volume expansion. It is important that the multiplicity of vesicles created by the gas be distinct units of similar volume. To attain uniform vesicles with reasonably uniform dispersion, proprietary chemical modifiers generally are added to the formulation in small quantities. These modifiers are available from several specialty chemical manufacturers in the United States and abroad. Using site specific requirements, foaming mud cement can be used to stabilize old mine workings with relatively economical backfill to: (a) terminate underground fires, (b) to prevent further subsidence, (c) to terminate excursions of fluids from the workings, (d) to terminate incursions of fluids into the workings, and in many cases (e) to serve as an effective repository for hazardous materials.

Looking now to the use of foaming mud cement as a repository for hazardous materials in an underground cavity, radio-active uranium tailings can be used, generally as-is, in foaming mud cement as a portion of the aggregate, substituting for the normal soil component. If it is desired to concentrate the tailings in units, the tailings can be pelletized and used as coarse aggregate. The tailings from various hard-rock mining operations generally are sulfides that leach during wet periods into the otherwise fresh water supply Preferably these sulfides are converted into high density pellets for inclusion as aggregates of foaming mud cement. Likewise, hazardous materials from old dump grounds can be dried and converted into high density pellets for inclusion as aggregates. In some cases it is desirable to increase the fidelity of individual pellets by mixing a small amount of cementitious material during the pelleting process.

It is an objective of the present invention to teach use of formulations of foaming mud cement that serve as a heat sink to remove underground localized hot spots through temperture reduction. It is another objective of the present invention to teach dispersion of hazardous waste material in foaming mud cement as a repository for permanent storage. Other objectives of the invention will be apparent as the description proceeds.

SUMMARY OF THE INVENTION

Specialty formulations of foaming mud cement are used in underground cavities to terminate fires and to disperse heat from residual underground fuel. In this manner the fire is terminated and residual fuel temperature is reduced below the ignition point temperature of the fuel, using a portion of the foaming mud cement containing additives that promote transfer of heat to the set cellular concrete. The formulations of the foaming mud cement are then changed as cavity fill continues to serve as a repository for permanent storage of hazardous materials. Upon complete cavity fill, the cavity is stabilized against further roof fall and against further incursions or excursions of fluids.

DESCRIPTION OF THE PREFERRED EMBODIMENTS

Figure 1:
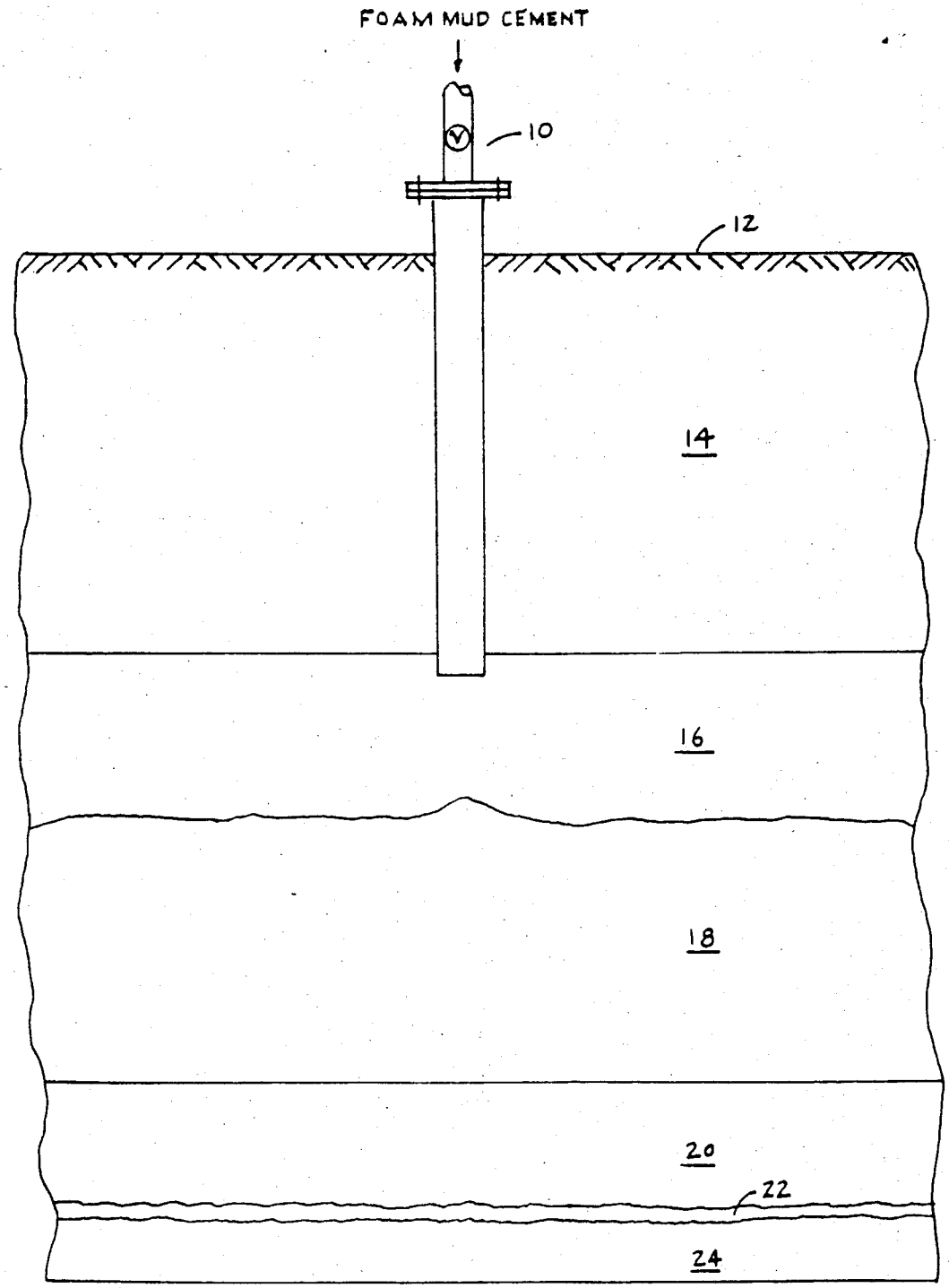
FIG. 1 is a diagrammatical vertical section taken through a portion of the earth showing a foaming mud cement injection well drilled into an underground coal cavity, illustrating the position of remnant coal, the transition zone, the enhanced thermal conductivity backfill and the backfill.

Referring first to FIG. 1, a foaming mud injection well 10 is drilled from the surface of the earth 12 through overburden 14 into an underground coal cavity 16, which extends downwardly to the top of remnant coal 24. The cavity was formed by mining coal, leaving remnant coal 24 in the mine floor. After mine abandonment, remnant coal was set afire accidentally.

Fire termination procedures were undertaken by injecting foaming mud cement through well 10 onto burning remnant coal 24, creating transition zone 22 between remnant coal 24 and mud cement 20. Transition zone 22 stabilizes as a layer of incompetent materials that are compressed by the weight of foaming mud cement backfill. Prior to stabilization, however, upon contact of the mud cement with the fire zone, a portion of the foaming mud cement is destroyed by the water content flashing to steam. Injection continues, preferably to a buildup of about one foot to one and a half feet of competent foaming mud cement overlying the transition zone, then injection is preferably stopped for a few minutes. During the first minute or two, gas vents form between the transition zone and the top of the blanket of foaming mud cement, such vents resembling the mud pots of a natural thermal feature. Within about five minutes the vents collapse with waning gas generation, and the fidelity of the blanket of foaming mud cement is restored. Thus, a barrier to exclude further incursion of oxygen to remnant coal 24 in in place. This barrier is later strengthened by the cement hardening into cellular concrete.

Upon completion of this sequence of steps, two localized hot spots remain in place: transition zone 22 and remnant coal 24. Unless these hot spots are significantly cooled, they remain a potential hazard for reignition of the coal should the oxygen exclusion barrier be breached by earthquake or other means. The overlying foaming mud cement is a poor conductor of heat, as is the resultant cellular concrete. Prior to injection of the foaming mud cement into the underground cavity, a formulation should be used that provides for enhanced thermal conductivity in zone 20 of Fig. 1. Zone 20 can vary in thickness, for example from one to about eight feet, depending on the nature of the original fire in remnant coal 24. The thickness of Zone 20 should be selected with due regard for the average stabilized temperature considered safe for Zones 24, 22 and 20.

Zone 20 then becomes a heat sink for stabilizing temperatures among the three lower zones. For zone 20 to become an effective heat sink, it is necessary to include thermal conductive aggregates to the formulation of foaming mud cement to be injected initially during fire termination procedures.

Figure 2:
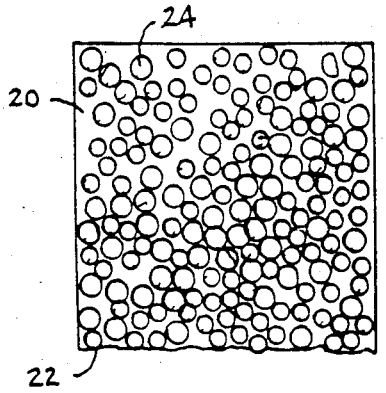
FIG. 2 is a diagrammatical vertical section of a portion of the enhanced thermal conductivity backfill showing the use of spheres as aggregate.

Referring now to FIG. 2, spheres or similar shapes of materials with good thermal conductivity are introduced as aggregate in the original mixing of the foaming mud cement initially injected. These shapes are dispersed throughout the cement mixture in random fashion. In place underground, this aggregate in part is in contact with transition zone 22, some shapes are in contact with adjacent shapes, other shapes are nearby to each other, all within the matrix of foaming mud cement within Zone 20 of FIG. 1. The spheres or shapes can be made of common materials as enumerated in a foregoing paragraph.

Figure 3:
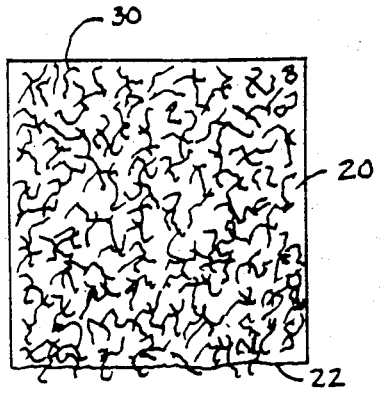
FIG. 3 is a diagrammatical vertical section of a portion of the enhanced thermal conductivity backfill showing the use of wires as an aggregate.

Referring to FIG. 3, an alternate embodiment is shown for aggregate in the form of small diameter, short length wires that are used in Zone 20 for enhanced thermal conductivity. To the formulation of foaming mud cement to be injected initially, these wires are introduced as a part of the cement mixing operation in surface factilties. The wires are dispersed in random fashion upon emplacement in the matrix of the cement in Zone 20 of FIG. 1. Some of the wires are in contact with Zone 22, in contact with each other, or nearby to each other throughout Zone 20. The wires can be made of common materials as enumerated in a foregoing paragraph.

Figure 4:
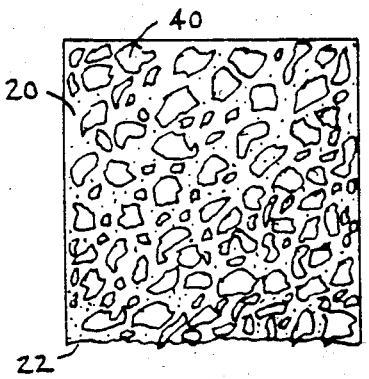
FIG. 4 is a diagrammatical vertical section of a portion of the enhanced thermal conductivity backfill showing use of crushed ores as the aggregate.

Referring to FIG. 4, a second alternate embodiment is shown for aggregate in the form of crushed mineralized materials. These materials can be common ores as described in a foregoing paragraph. Generally it is preferred that the crushed mineralized material be a substitute for the soil material normally used foaming mud cement for injection into Zone 20 of FIG. 1. These crushed mineralized materials are in contact with Zone 22 and with each other in the matrix of cement within Zone 20.

Figure 5:
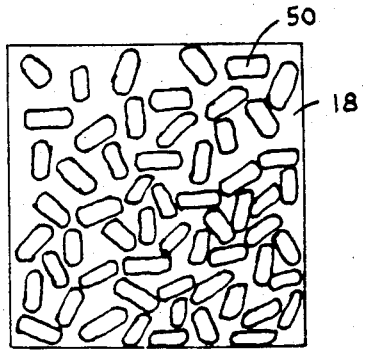
FIG. 5 is a diagrammatical vertical section showing a portion of the regular backfill wherein hazardous waste pellets are used as an aggregate.

Upon completion of injection of foaming mud cement into Zone 20 of FIG. 1, cavity fill resumes by injecting foaming mud cement in Zone 18. At sites considered suitable for permanent storage of hazardous waste, Zones 18 and 16 can be filled with a formulation of foaming mud cement prepared for this purpose. When the hazardous waste is uranium tailings, preferably the tailings are used as a substitute for the soil component of foaming mud cement. When the hazardous waste is sulfide tailings from hard rock mining and milling operations, preferably the waste is pelletized and used as aggregate in the foamed cement formulation during mixing operations. The dispersed pellets are then within the cement matrix of the backfill of foamed cement as shown in FIG. 5. Other types of hazardous waste can be pelletized similar to sulfide tailings and used as described for permanent storage in foamed cement that sets into cellular concrete.

The backfill process continues, preferably to complete cavity fill. Upon completion of the backfill, the casing of well 10 is pulled and the wellbore is plugged, preferably with foaming mud cement without specialty additives.

Thus it may be seen that various formulations of foaming mud cement may be effectively used in underground cavities to terminate underground fires, to serve as a heat sink to stabilize underground temperatures, to prevent further subsidence, to terminate excursions of fluids from the cavity, to terminate incursions of fluids into the cavity, and, in many cases to serve as a permanent repository for hazardous waste materials.

While the present invention has been described with a certain degree of particularity, it is recognized that the disclosure has been made by way of example, and that chances in detail of structure may be made without departing from the spirit therof. It will be appreciated that this invention is not limited by any theory of operation, but any theory that has been advanced is merely to facilitate disclosure of the invention.

What is claimed is:

1. A method of terminating a persistent underground coal fire using foaming mud cement, comprising the steps of establishing a communication passage between the surface of the earth and the underground cavity associated with the coal, injecting a first quantity of foaming mud cement through the communication passage and onto the burning coal, wherein the first quantity of foaming mud cement forms a blanket over the burning coal, the foaming mud cement, upon contacting the burning coal generating gases which form vents through the injected foaming mud cement, terminating injection of the first quantity of foaming mud cement until the generation of gases wanes at the interface between the hot coal and the injected foaming mud cement, with resultant collapse of vents through the foaming mud cement, then resuming injection with a second quantity of foaming mud cement into the underground cavity.

2. The method of claim 1 wherein injection of the second quantity of foaming mud cement continues until the underground cavity is completely backfilled.

3. The method of claim 1 wherein the first quantity of foaming mud cement contains a thermal conductive aggregate, with the resultant conversion of the first quantity of foaming mud cement into a heat sink.

4. The method of claim 3 wherein the thermal conductive aggregate is spheres of metal material.

5. The method of claim 3 wherein the thermal conductive aggregate is random shapes of metal material.

6. The method of claim 3 wherein the thermal conductive aggregate is metal wires disposed in random alignments.

7. The method of claim 3 wherein the thermal conductive aggregate is crushed metallic ores.

8. The method of claim 1 wherein the second quantity of foaming mud cement contains an aggregate composed of hazardous material.

9. The method of claim 8 wherein the aggregate of hazardous material is radioactive uranium tailings.

10. The method of claim 9 wherein the uranium tailings are pelletized.

11. The method of claim 8 wherein the aggregate of hazardous material is sulfide tailings.

12. The method of claim 11 wherein the sulfide tailings are pelletized.

* * * * *